US007874328B2

(12) United States Patent
Dancyger

(10) Patent No.: US 7,874,328 B2
(45) Date of Patent: Jan. 25, 2011

(54) UTILITY BAG

(75) Inventor: Michael Dancyger, Los Angeles, CA (US)

(73) Assignee: Custom Leathercraft Manuf., Inc., South Gate, CA (US)

( * ) Notice: Subject to any disclaimer, the term of this patent is extended or adjusted under 35 U.S.C. 154(b) by 1051 days.

(21) Appl. No.: 11/347,541

(22) Filed: Feb. 3, 2006

(65) Prior Publication Data

US 2007/0181394 A1 Aug. 9, 2007

(51) Int. Cl.
*A45C 1/02* (2006.01)

(52) U.S. Cl. ..... 150/112; 150/106; 150/113; 190/109; 190/110; 206/234

(58) Field of Classification Search ..... 190/109, 190/111, 112, 113, 117, 110; 150/106, 112, 150/113; 224/653; 206/234
See application file for complete search history.

(56) References Cited

U.S. PATENT DOCUMENTS 1,367,574 A * 2/1921 White ..... 190/111
1,495,046 A * 5/1924 Spiegel ..... 190/111
2,131,583 A * 9/1938 Crotty et al. ..... 211/99
2,604,917 A * 7/1952 Reilly ..... 150/111
RE25,826 E * 8/1965 Ward ..... 190/108
3,410,376 A * 11/1968 Benzel ..... 190/110
4,662,513 A * 5/1987 King et al. ..... 206/287.1
4,739,809 A * 4/1988 Adams ..... 150/112
5,310,031 A * 5/1994 Plath ..... 190/18 A
5,441,134 A * 8/1995 Carson ..... 190/111
5,873,504 A * 2/1999 Farmer ..... 224/576
5,908,093 A * 6/1999 Miyoshi ..... 190/115
5,967,270 A * 10/1999 Shyr ..... 190/109
6,102,172 A * 8/2000 Dercole ..... 190/18 A
6,105,844 A * 8/2000 Walters et al. ..... 224/610

* cited by examiner

*Primary Examiner*—Tri M Mai

(57) ABSTRACT

A utility bag having a compartment recessed in an upper portion of the utility bag to provide additional storage space and utilize unused space in compartments thereof. The recessed compartment may accommodate various items including tools and trays for storing small items.

13 Claims, 5 Drawing Sheets

UTILITY BAG

FIELD OF THE INVENTION

The present invention relates generally to utility bags for carrying a plurality of items and more particularly to a utility bag having a compartment recessed in an upper portion of the utility bag to provide additional storage space.

BACKGROUND OF THE INVENTION

There are currently in use many different types of utility bags used by various tradesmen, construction workers, handymen, plumbers, carpenters, fishermen and the like. These bags conventionally provide for numerous compartments or pockets for containing, storing and carrying items of various sizes and shapes. The compartments and pockets allow a user to aggregate and store articles of similar size and/or function for easy retrieval.

One such utility bag is disclosed in U.S. Pat. No. 5,873,504 entitled "Carrying Bag". The carrying bag is formed of flexible material having an upper compartment and a lower compartment separated by a dividing wall. The carrying bag includes a zippered closure extending around three sides of the bag which allows access to the lower compartment and permits the upper compartment to be pivoted away from the lower compartment. The lower compartment includes a unitary, divided tray for storing articles therein.

A utility bag disclosed in U.S. Pat. No. 6,213,268 and issued to the present inventor has a generally rectangular first compartment which has an opening therein and contains at least one removable tray. A second substantially pocketbook shaped compartment has an opening formed at an upper end to enable access to an inside portion thereof. Pockets sized so as to accommodate elongated objects of varying weight and size, are attached around a perimeter of the bag.

Despite the provision of various compartments and pockets, inefficiencies in the utilization of space within utility bags continues to be a problem. For example, after the upper or pocketbook shaped compartment is filled with tools, implements, containers and the like, unused space remains within the compartment. Attempts to fill this unused space may lead to problems in finding desired items as the items may become lost or buried within the compartment.

There is therefore a need in the art for a utility bag that overcomes the disadvantages of the prior art. There is a need for a utility bag that provides for utilization of unused space in compartments of the utility bag. There is also a need for a utility bag having a compartment recessed in an upper portion of the utility bag to provide additional storage space.

SUMMARY OF THE INVENTION

The present invention provides a utility bag having a compartment recessed in an upper portion of the utility bag to provide additional storage space and utilize unused space in compartments thereof. The recessed compartment may accommodate various items including tools and trays for storing small items.

In accordance with one aspect of the invention, a utility bag includes a lower portion, an upper portion, and a compartment recessed in the upper portion. The utility bag includes side portions and end portion. The compartment may be recessed in a side portion upper portion and in an end portion upper portion.

In accordance with yet another aspect of the invention, a compartment for accommodating an item in a utility bag includes opposed side walls, a top wall, a bottom wall and a rear wall, the opposed side walls, top wall, bottom wall and rear wall being recessed in an upper portion of the utility bag.

In accordance with another aspect of the invention, a utility bag includes a lower portion and an upper portion having opposed side walls, a top wall, a bottom wall and a rear wall defining a recessed compartment extending into an inside portion of the utility bag.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of components and to the arrangements of these components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present disclosure may be better understood and its numerous features and advantages made apparent to those skilled in the art by referencing the accompanying drawings.

DETAILED DESCRIPTION OF THE INVENTION

Figure 1:
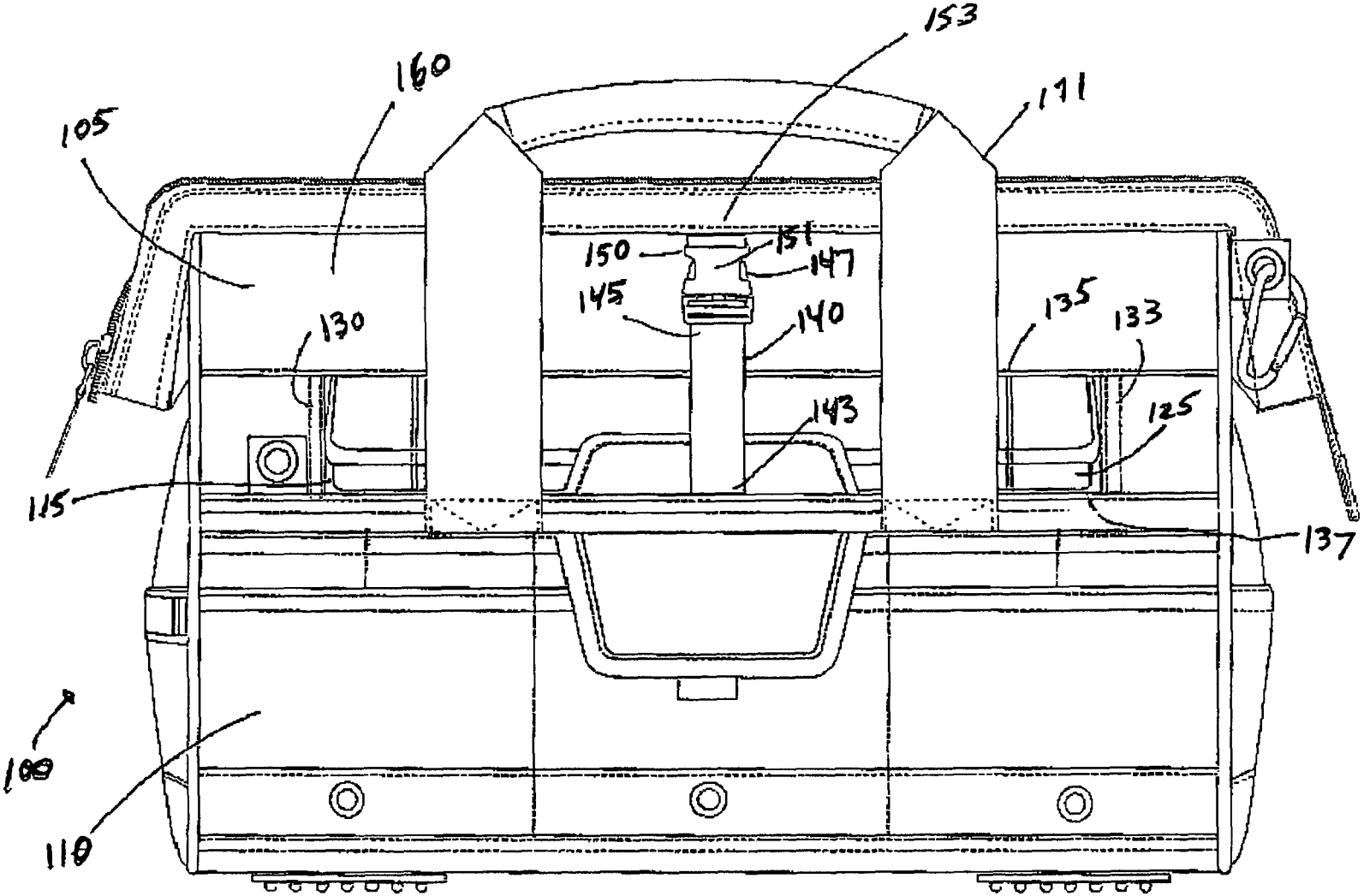
FIG. 1 is a side elevation view of a side portion of the utility bag in accordance with the invention.
Figure 2:
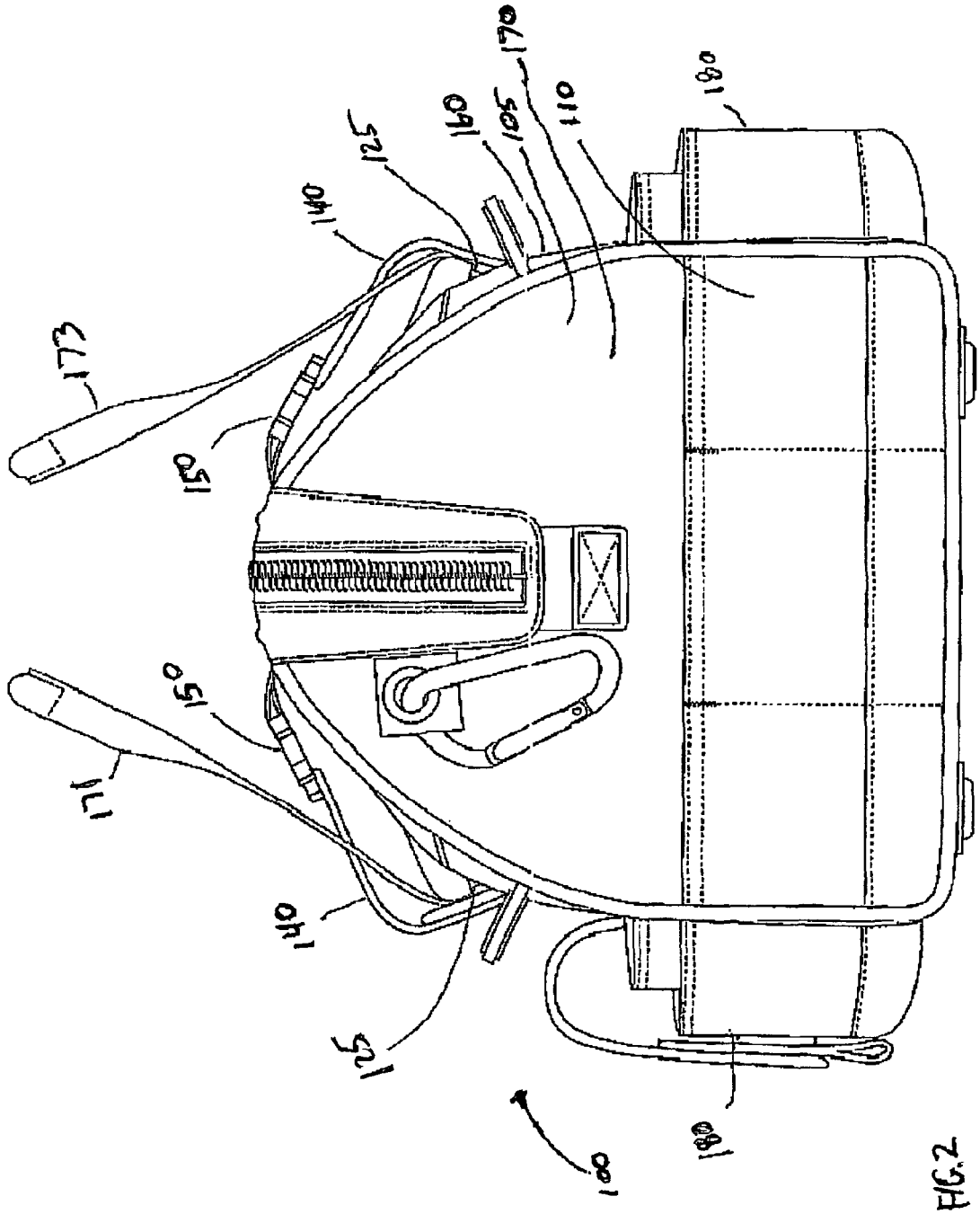
FIG. 2 is a side elevation view of an end portion of the utility bag in accordance with the invention.

With reference to FIGS. 1-4, a utility bag generally designated 100 is shown including an upper portion 105 and a lower portion 110. A compartment 115 is recessed in the upper portion 105 and extends into an inside portion 120 of the utility bag 100. Compartment 115 may accommodate and carry a removable tray 125 having a plurality of compartments (not shown) so that small and minute items may be carried therein. Tray 125 has a removable lid 127 thereon, which prevents the contents of the tray 125 from shifting, mixing or falling out during transport.

Alternatively, a plurality of smaller trays (not shown) or other tools and items may be carried within the compartment 115.

Compartment 115 includes opposed side walls 130 and 133, a top wall 135, a bottom wall 137 and a rear wall 139.

Side walls 130 and 133, the top wall 135, the bottom wall 137 and the rear wall 139 may form a compartment of generally rectangular cross section. Edges of the walls of the compartment 115 may be attached with re-enforced edging.

Compartment 115 may have a structural element (not shown) enclosed therein to maintain the structural integrity of the compartment 115. The structural element can be made of any suitable material including wood, metal, plastic and composite materials. In a typical embodiment, the structural element comprises metal wire or a rigid cardboard.

A strap assembly including a strap 140 may retain the tray 125 or other item within the compartment 115. The strap 140 may be sewn to the upper portion 105 at an end 143 thereof at a location proximate the bottom wall 137 of the compartment 115. A locking end 145 of the strap 140 includes a male portion 147 of a quick release clip lock 150 having a female portion 151 coupled to a top portion 153 of the upper portion 105. Clipping the male portion 147 to the female portion 151 secures the strap 140 across the tray 125 so as to secure the tray 125 within the compartment 115.

Figure 3:
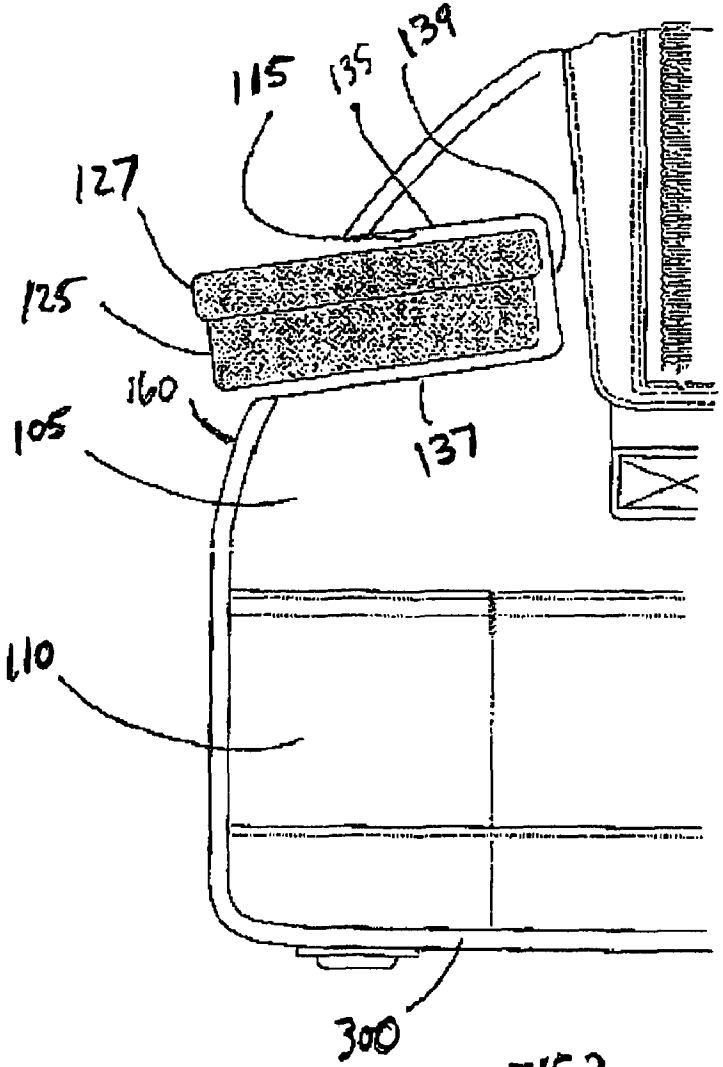
FIG. 3 is a partial cross sectional view of the utility bag in accordance with the invention.
Figure 4:
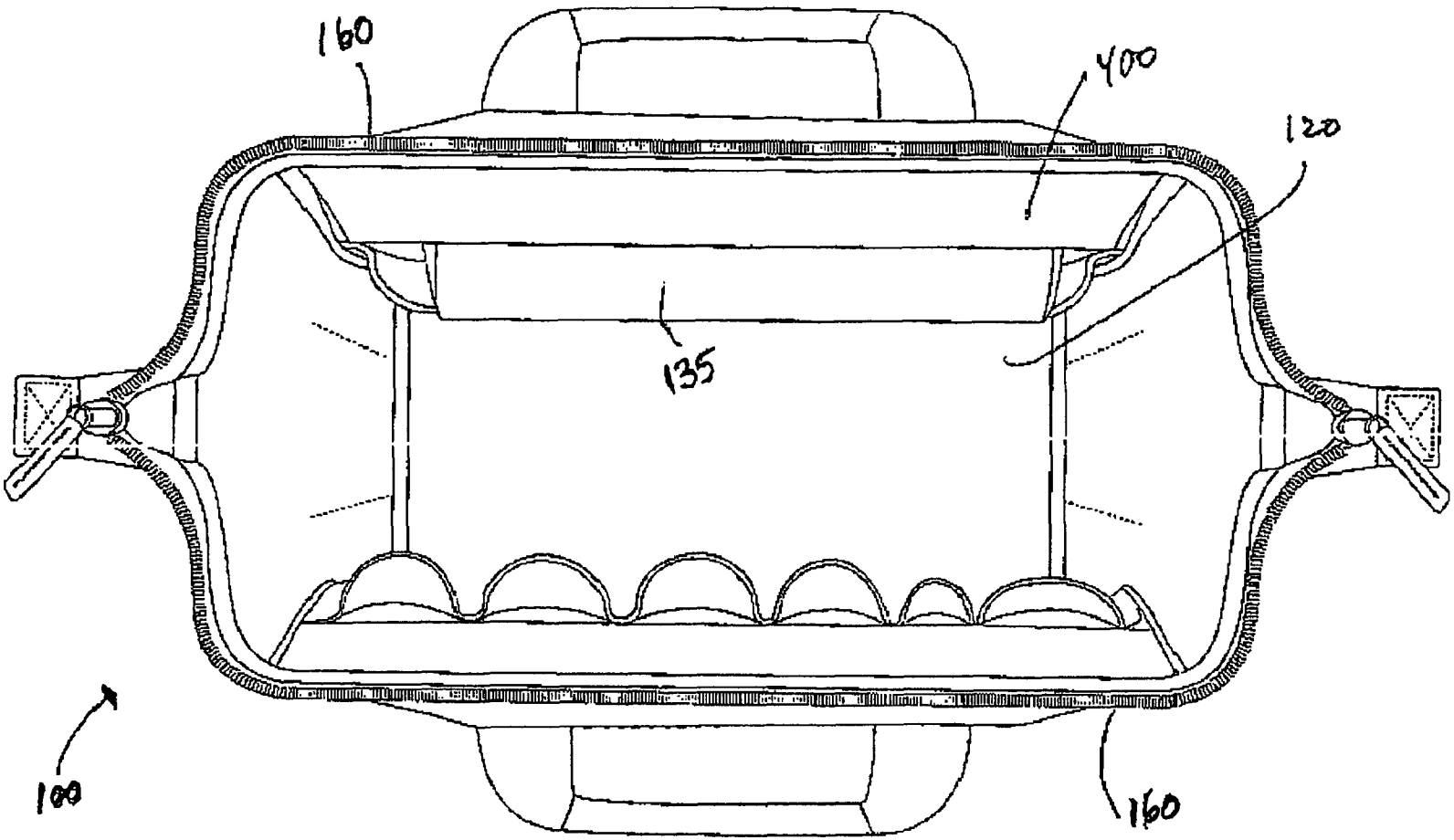
FIG. 4 is a top plan view of the utility bag in accordance with the invention.

With particular reference to FIG. 3, the compartment 115 may be recessed in the upper portion 105 at an upward angle relative to a bottom surface 300 of the utility bag 100. The upward angle of compartment 115 serves to efficiently utilize space in the inside portion 120 of the utility bag 100. As shown in FIG. 4, the upward angle provides that the top wall 135 of the compartment 115 is disposed proximate a lateral inside wall 400 of the utility bag 100.

Figure 5:
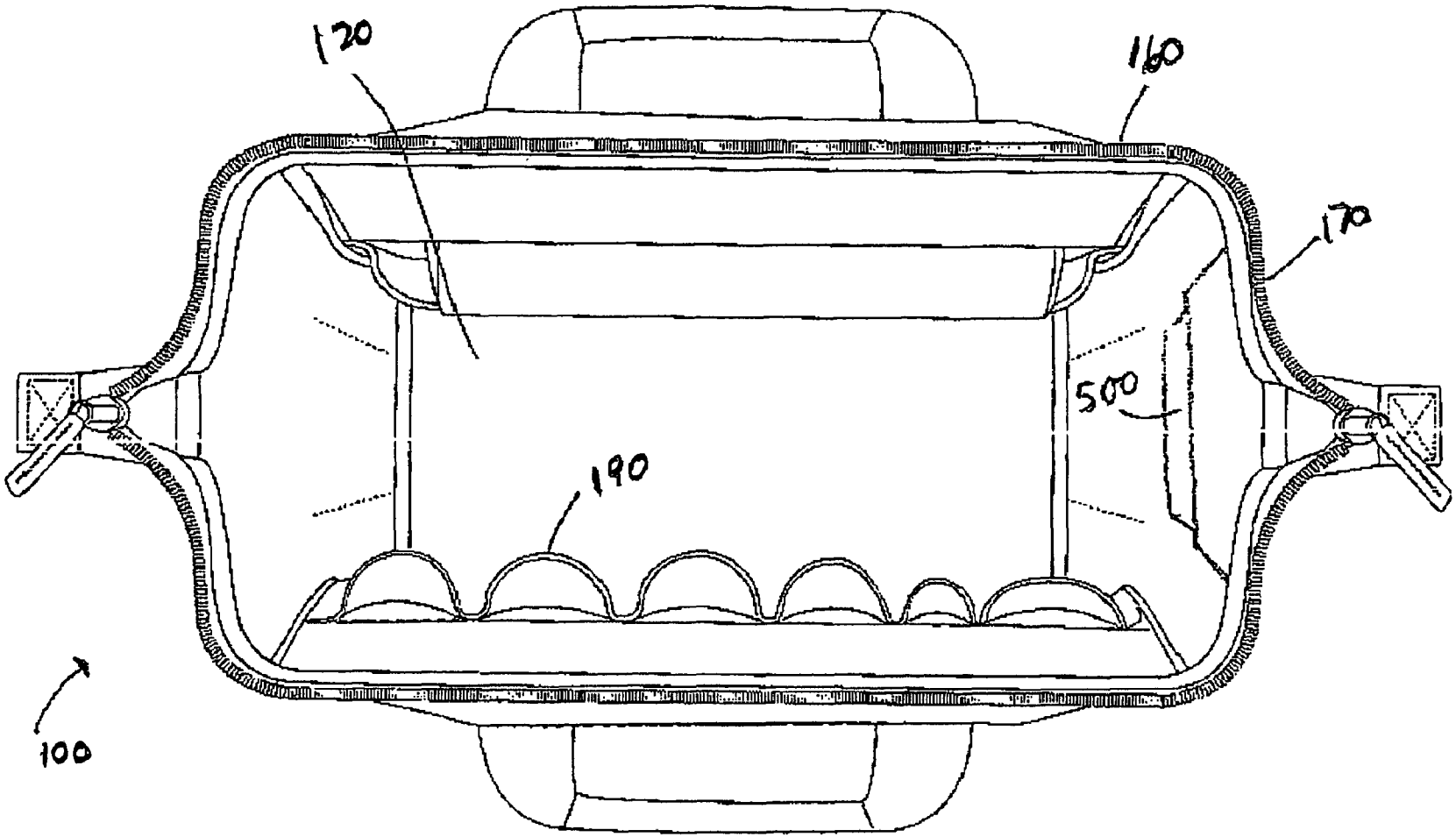
FIG. 5 is a top plan view of an alternative embodiment of the utility bag in accordance with the invention.

In a preferred embodiment of the invention, the compartment 115 is recessed in the upper portion 105 of the utility bag 110 along a side portion 160 thereof as shown in FIGS. 1-4. One or more compartments 115 may be recessed in opposite side portions 160. Alternatively, the compartment 115 may be recessed in the upper portion 105 of the utility bag 100 along an end portion 170 thereof as shown in FIG. 5. An upper wall 500 of compartment 115 may extend into the inside portion 120 of the utility bag 100.

The utility bag 100 includes handles 171 and 173 to permit the utility bag 100 to be picked up and carried. Handles 171 and 173 may include flexible straps. Handles 171 and 173 are preferably attached to the utility bag 100 by stitching or other suitable means. Handles 171 and 173 may be constructed of heavy duty nylon.

Pockets 180 may be attached around a perimeter of the utility bag 100 to accommodate elongated objects of varying size and weight. Pockets 190 may also be formed in the inside portion 120 of the utility bag 100 for the same purpose.

In a preferred embodiment, the utility bag 100 is made of a heavy duty lightweight material such as Cordura or of a stiff canvas because of its relative rigidity, durability, light weight and ease with which it can be fastened together. However, if more flexible walls are desirable, the utility bag 100 can be made of any thin flexible material, such as cloth, flexible plastic or rubber.

The compartment 115 recessed in the upper portion 105 provides additional storage space and utilizes unused space in the inside portion 120 of the utility bag 100. The angled configuration of the compartment 115 maximizes the utilization of the unused space.

It should be understood, of course, that the foregoing relates to preferred embodiments of the invention and that modifications may be made without departing from the spirit and scope of the invention as set forth in the following claims.

I claim:

1. A utility bag comprising:

a lower portion coupled to a bottom of the utility bag;

an upper portion extending from a top of the lower portion to a top of the utility bag having an interior portion access opening;

a compartment extending into the interior portion of the utility bag at an upward angle relative to a bottom surface of the lower portion, wherein the compartment is recessed in a side of the utility bag of the upper portion, wherein the compartment is non-accessible from the interior portion of the utility bag, and the compartment extends from the side of the utility bag towards the top of the utility bag at an acute angle; and a removable tray having a first portion accommodated fully within the compartment and abutted to an end of the compartment, and a second portion extending outside of an exterior of the side of the utility bag, wherein the tray is removable from the side of the utility bag.

2. The utility bag of claim 1, further comprising an end portion upper portion, the compartment being recessed in the end portion upper portion.

3. The utility bag of claim 1, wherein the compartment comprises opposed side walls, a top wall, a bottom wall and a rear wall.

4. The utility bag of claim 1, further comprising a strap assembly for retaining an item in the compartment, the strap assembly comprising a strap attached at one end thereof to the upper portion proximate a bottom wall of the compartment and at another end thereof to a male portion of a quick release clip lock, the male portion being engageable to a female portion attached to a top portion of the upper portion.

5. The utility bag of claim 1, wherein the compartment includes a structural element configured to maintain structural integrity of the compartment.

6. The utility bag of claim 1, further comprising a plurality of pockets attached to the lower portion.

7. The utility bag of claim 1, further comprising a plurality of pockets attached to an inside surface.

8. A utility bag having a compartment for accommodating an item, the compartment comprising:

opposed side walls, a top wall, a bottom wall and a rear wall, the opposed side walls, top wall, bottom wall and rear wall being recessed in an upper portion extending from a top of a lower portion of the utility bag; and a structural element configured to maintain structural integrity of the compartment, wherein the compartment extends at an upward acute angle from a side of the utility bag towards a top of the utility bag and into an interior portion of the utility bag, and the compartment configured to hold a first portion of a removable tray up to an end of the compartment while a second portion of the removable tray extending outside of an exterior of the side of the utility bag.

9. The utility bag of claim 8, wherein the compartment is recessed in an upper portion of the side portion of the utility bag.

10. The utility bag of claim 8, wherein the compartment is recessed in the upper portion of an end portion of the utility bag.

11. A utility bag comprising:

a lower portion coupled to a bottom of the utility bag;

an upper portion extending from a top of the lower portion to a top of the utility bag having an interior portion access opening;

a compartment extending into the interior portion of the utility bag at an upward angle relative to a bottom surface of the lower portion, wherein the compartment is recessed in a side of the utility bag of the upper portion;

a removable tray having a first portion accommodated fully within the compartment and abutted to an end of the compartment, and a second portion extending outside of an exterior of the side of the utility bag; and a strap assembly for retaining an item in the compartment, the strap assembly comprising a strap attached at one end thereof to the upper portion proximate a bottom wall of the compartment and at another end thereof to a male portion of a quick release clip lock, the male portion being engageable to a female portion attached to a top portion of the upper portion, wherein the tray is removable from the side of the utility bag.

12. The utility bag of claim 11, wherein the compartment being recessed in the side portion of the upper portion.

13. The utility bag of claim 11, further comprising an end portion of the upper portion, the compartment being recessed in the end portion of the upper portion.

* * * * *